United States Patent [19]

Sakamaki et al.

[11] Patent Number: 4,623,138

[45] Date of Patent: Nov. 18, 1986

[54] PAPER FEEDING DEVICE FOR COPYING MACHINE

[75] Inventors: Katsumi Sakamaki; Yasuyuki Fukagawa, both of Kanagawa, Japan

[73] Assignee: Fuji Xerox Co., Ltd., Tokyo, Japan

[21] Appl. No.: 521,508

[22] Filed: Aug. 8, 1983

[30] Foreign Application Priority Data

Aug. 6, 1982 [JP] Japan ..... 57-136376
Aug. 6, 1982 [JP] Japan ..... 57-136377
Aug. 6, 1982 [JP] Japan ..... 57-136378

[51] Int. Cl.[4] ..... B65H 3/54; B65H 3/56; B65H 1/12

[52] U.S. Cl. ..... 271/170; 271/160; 271/169

[58] Field of Search ..... 271/170, 246, 161, 145, 271/171, 22, 21, 24, 25, 19, 167, 169, 160

[56] References Cited

U.S. PATENT DOCUMENTS 390,277 10/1888 Allen ..... 101/232 X
3,601,389 8/1971 Kramer ..... 271/170

FOREIGN PATENT DOCUMENTS 0031830 2/1983 Japan ..... 271/167

*Primary Examiner*—Bruce H. Stoner, Jr.
*Assistant Examiner*—Lawrence J. Goffney, Jr.
*Attorney, Agent, or Firm*—Sughrue, Mion, Zinn, Macpeak, and Seas

[57] ABSTRACT

A paper feeding device for a copier or the like enables reliable feeding of thicker paper products by providing at least one pivotable holding arm carrying a paper pressing member and a contacted adjacent elastic member. The feeding of the topmost paper effects deformation of the elastic member until a gap is formed sufficient to pass one sheet, following which the sheet is advanced. Further sheets are prevented from being passed together with the first sheet by the size of the gap and frictional resistance. The elastic member may be formed of an elastomer such as natural rubber and may include an upper hollow defining a contact surface of arcuate shape.

3 Claims, 8 Drawing Figures

PAPER FEEDING DEVICE FOR COPYING MACHINE

BACKGROUND OF THE INVENTION

The present invention relates to a paper feeding device for use in a copying machine, and more particularly, to a paper feeding device for feeding sheets having a relatively large thickness, such as post cards and index cards.

In a conventional paper feeding device of such type, a pivotably supported corner claw b is provided at a front end of a paper feeding cassette a on each side thereof as shown in FIG. 1. Papers are fed one by one with the assistance of the claws b.

However, in case of thick papers such as post cards and index cards, in order to buckle the papers with the assistance of the corner claws b and to feed only the uppermost paper in the stack, a large feeding force is required. As a matter of fact, it is difficult to effectively use such corner claws b for feeding such papers.

Also, the side pad method has conventionally been used for controlling paper-feeding. This method is inferior in reliability because the side pads are abraded over long term use due to the frictional contact between the side edges of the paper and the side pads.

Other conventional methods also include the retard roll method, the retard belt method and the like. However, to practice such methods, the total cost for a compact or small copying machine is unduly disadvantageously increased.

SUMMARY OF THE INVENTION

In view of the above-noted defects, an object of the invention is to provide a novel paper feeding device enabling the feeding of relatively thick papers one by one with high accuracy and without imparting damage thereto.

In order to attain this and other objects of the invention, there is provided a paper feeding device comprising a pair of holding arms movable up and down and provided on both sides of a cassette body, said holding arms each having a paper pressing member at an end portion thereof, and an elastic member elastically deformable when a copying paper is fed from a stack by a feeding roller and which forms a gap through which the copying paper may pass, between the elastic member and the paper pressing member, said elastic member being provided at the end of the holding arm.

DETAILED DESCRIPTION OF THE PREFERRED EMBODIMENTS

The present invention will now be described in detail with reference to FIGS. 2 through 8.

Figure 1:
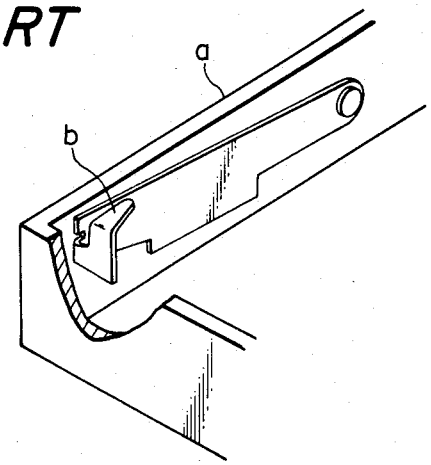
FIG. 1 PRIOR ART
FIG. 1 is a perspective view showing a part of a conventional paper feeding device.
Figure 2:
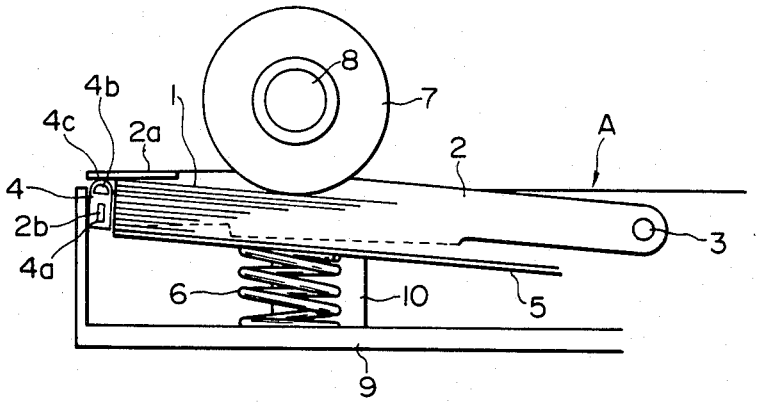
FIG. 2 is a longitudinal sectional view showing one embodiment of the invention.
Figure 3:
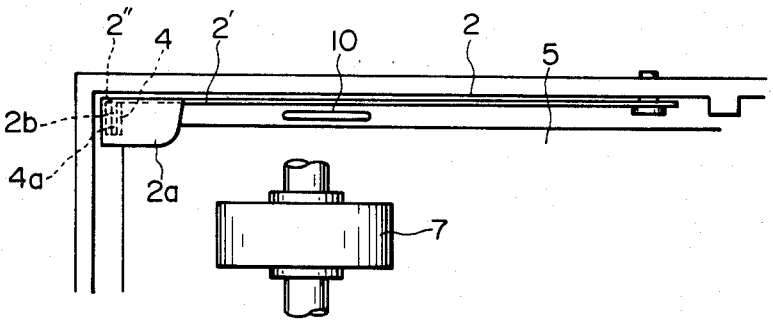
FIG. 3 is a partial plan view of the embodiment shown in FIG. 2.
Figure 4:
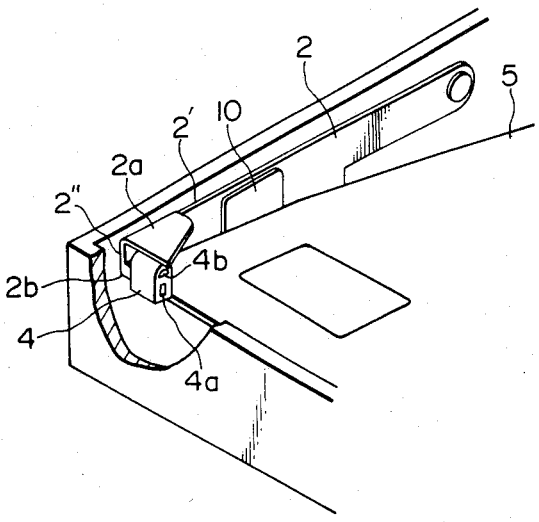
FIG. 4 is a fragmentary perspective view of the embodiment.

In FIG. 2, a feeding roller 7 is incorporated in the body of a copying machine (not shown) and is fixed to a drive shaft 8 and driven thereby. Reference character A generally designates a paper feeding cassette including a cassette body 9, in which a bottom plate 5 is provided for up and down movement. Between the bottom plate 5 and the bottom of the cassette body 9 is interposed a spring 6 for pressing a stack of copying papers 1 disposed on the bottom plate 5 against the feeding roller 7 at a predetermined pressure.

Inside of the cassette body 9, a holding arm 2 is mounted on a wall of the cassette body 9 such that the holding arm 2 is rotatable about a pivot shaft 3.

A paper pressing member or plate 2*a* extending horizontally is formed at the distal end of the holding arm 2. An elastic member mounting member 2*b* on which an elastic member 4 is mounted is provided at the distal end of the holding arm 2. The elastic member 4 is pressingly secured onto the elastic member mounting member 2*b*.

More specifically, the paper pressing member 2*a* is formed of a thin planar plate integral with an upper end face 2′ of the holding arm 2 and extends inwardly therefrom up to an end face 2″, and the elastic member mounting member 2*b* is formed of a thin planar plate integral with the end face 2″ if the holding arm 2 and extends inwardly therefrom. In addition, the elastic member 4 has an upper hollow space 4*b* and a mounting hole 4*a* into which the elastic member mounting member 2*b* is pressingly inserted. An upper surface 4*c* of the elastic member is curved in an arcuate shape. The elastic member 4 is mounted by inserting the elastic member mounting member 2*b* into the mounting hole 4*a* whereupon the upper surface 4*c* is slightly deformed in abutment with a lower surface of the paper pressing member 2*a*. It is preferable that the elastic member 4 be made of a material having a high frictional coefficient relative to that of the copying paper 1, such as urethane rubber or other material exhibiting elastic deformation.

Under the condition that the paper pressing member 2*a* is set on the stack of paper by the gravitational force of the holding arm 2, the elastic member 4 confronts the ends of the copying papers 1.

Between the bottom plate 5 and the holding arm 2 is provided a partitioning wall 10 formed integrally with the cassette body 9. The partitioning wall renders the papers 1 aligned with each other widthwise and fixed.

Figure 5:
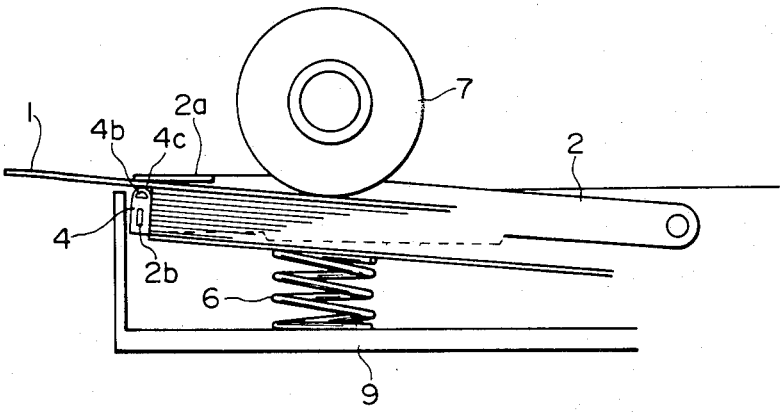
FIG. 5 shows a state in which a paper is fed from the cassette of the embodiment.

In operation, when a start button (not shown) for copying is depressed, the feeding roller 7 is driven and the uppermost paper 1 is fed and brought into contact with the elastic member 4. The elastic member 4 is bent by the paper feeding force and the resilient strength of the paper 1. As a result, a gap will form between the upper surface 4*c* of the elastic member 4 and the paper pressing member 2*a*. When this gap grows to an extent such that the paper 1 may pass through the gap, the paper is fed through the gap as shown in FIG. 5.

At this time, if a second paper or other papers 1 in the stack are fed together with the uppermost paper simultaneously, the second or other papers 1 come into abutment with the elastic member 4 and stop due to the frictional resistance between the elastic member 4 and the paper 1. Thus, in such a case, double paper feeding may be prevented in the cassette A.

Also, since the elastic member 4 is provided with the upper hollow space 4*b* and the upper surface 4*c* is curved in an arcuate shape, any variation in contact pressure applied to the paper pressing member 2*a* by the elastic member 4 due to deviations in the dimensions of the mounted mechanical components may be absorbed so that an optimal contact pressure results. The upper surface 4*c* is pressed against the paper pressing member 2*a*, and at the same time, since the contact area of the upper surface 4*c* is widened to enhance the paper feeding action, double paper feeding may be effectively prevented.

Figure 6:
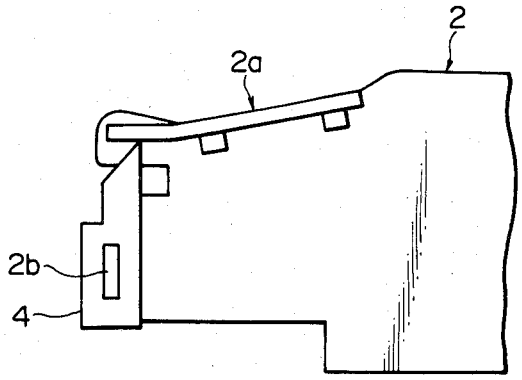
FIGS. 6 to 8 are side views showing modifications of the elastic member shown in FIGS. 2 to 5.
Figure 7:
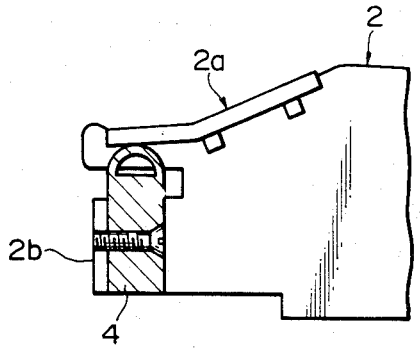
Figure 8:
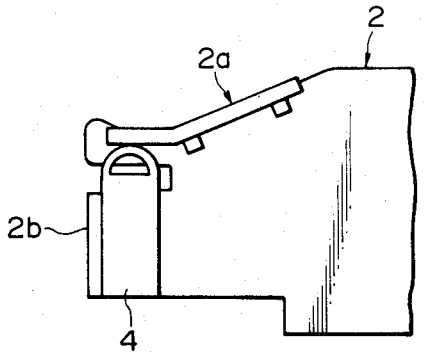

Modifications according to the invention will now be described with reference to FIGS. 6 to 8. In FIG. 6, the elastic member 4 has a triangular cross section tapered toward its end. In this case, substantially the same effect as in the foregoing embodiment may be obtained. In FIG. 7, the elastic member 4 is fixed to the elastic member mounting member 2*b* by a screw. In FIG. 8, the elastic member 4 is fixed to the elastic member mounting member 2*b* by adhesives. The elastic member 4 may be made of a natural rubber having a high frictional coefficient of more than 0.8 and a hardness of 30° to 50°. This contributes not only to the paper feeding action but also to enhanced durability.

The cassette A according to the invention is applicable to conventional copying machines without any modification of the copying machine being necessary.

Also, with the conventional paper feeding cassette having corner claws, it is possible to remove the corner claws and instead thereof mount the holding arm according to the invention. In this case, the cassette body, bottom plate and the like may be commonly used to remarkably reduce the cost of reducing the invention to practice.

As described above, the present invention may provide a paper feeding cassette enabling the feeding of thick papers one by one without any damage being imposed on the paper.

What is claimed is:

1. A paper feeding device, comprising:

a paper cassette having a lower support surface for supporting a stack of papers, said paper cassette having a first end from which papers are provided from said cassette in a paper feeding direction;

paper holding means for holding said stack of papers on said lower support surface, said paper holding means including a holding arm arranged for up and down movement and having an end adjacent said first end of said cassette, and a paper pressing member fixed to said end of said holding arm for resting on a forward end of an uppermost paper of said paper stack;

paper feeding means for feeding said uppermost paper from said stack by contacting said uppermost paper at a position displaced from said paper pressing member in a direction opposite said paper feeding direction; and paper feed controlling means, including an elastic member provided at said end of said holding arm beneath said pressing member and bias means for biasing said elastic member and pressing member for relative movement toward one another such that an upper surface of said elastic member is pressed against said paper pressing member, said elastic member being elastically deformable and forming a gap between itself and said paper pressing member when said uppermost paper is fed from said stack by said paper feeding means, so as to pass said uppermost paper, said elastic member including an upper hollow space therein, said upper surface being curved arcuately, said upper surface being normally contacted with said paper pressing member.

2. A paper feeding device, comprising:

a paper cassette having a lower support surface for supporting a stack of papers, said paper cassette having a first end from which papers are provided from said cassette in a paper feeding direction;

paper holding means for holding said stack of papers on said lower support surface, said paper holding means including a holding arm arranged for up and down movement and having an end adjacent said first end of said cassette, and a paper pressing member fixed to said end of said holding arm for resting on a forward end of an uppermost paper of said paper stack;

paper feeding means for feeding said uppermost paper from said stack by contacting said uppermost paper at a position displaced from said paper pressing member in a direction opposite said paper feeding direction; and paper feed controlling means, including an elastic member provided at said end of said holding arm beneath said pressing member and bias means for biasing said elastic member and pressing member for relative movement toward one another such that an upper surface of said elastic member is pressed against said paper pressing member, said elastic member being elastically deformable and forming a gap between itself and said paper pressing member when said uppermost paper is fed from said stack by said paper feeding means, so as to pass said uppermost paper, said elastic member including a lower hollow space into which is inserted a securing means of said holding arm.

3. A device according to claim 2, said elastic member further including an upper hollow space defining upwardly thereof a flexible contact portion of arcuate shape.

* * * * *